US010005252B2

(12) United States Patent
Kanzler et al.

(10) Patent No.: US 10,005,252 B2
(45) Date of Patent: Jun. 26, 2018

(54) SCREW PRESS

(75) Inventors: Roland Kanzler, Graz (AT); Rudolf Stadlauer, Eggersdorf (AT); Johannes Knafl, Graz (AT); Wolfgang Magor, Kumberg (AT)

(73) Assignee: Andritz AG, Graz (AT)

( * ) Notice: Subject to any disclaimer, the term of this patent is extended or adjusted under 35 U.S.C. 154(b) by 1082 days.

(21) Appl. No.: 14/351,342

(22) PCT Filed: Sep. 10, 2012

(86) PCT No.: PCT/EP2012/003785

§ 371 (c)(1),
(2), (4) Date: Sep. 19, 2014

(87) PCT Pub. No.: WO2013/053418

PCT Pub. Date: Apr. 18, 2013

(65) Prior Publication Data

US 2015/0224730 A1 Aug. 13, 2015

(51) Int. Cl.
*B30B 9/12* (2006.01)
*B30B 9/16* (2006.01)

(52) U.S. Cl.
CPC ..... *B30B 9/121* (2013.01); *B30B 9/122* (2013.01); *B30B 9/166* (2013.01)

(58) Field of Classification Search
CPC ..... B30B 9/121; B30B 9/166; B30B 9/122
See application file for complete search history.

(56) References Cited

U.S. PATENT DOCUMENTS 3,085,623 A * 4/1963 Ginaven ..... B30B 9/122 100/148
4,121,967 A * 10/1978 Reinhall ..... D21B 1/22 162/246
4,202,773 A * 5/1980 Fink ..... B04B 1/20 100/117
4,581,992 A * 4/1986 Koch ..... B30B 9/121 100/117
4,983,256 A * 1/1991 Combette ..... B30B 9/121 162/140
5,516,427 A * 5/1996 Yoshikawa ..... B01D 29/356 100/117
5,857,405 A * 1/1999 Bischof ..... B30B 9/12 100/117
5,857,406 A * 1/1999 Scheucher ..... B30B 9/12 100/112
6,096,201 A * 8/2000 Bruke ..... B01D 21/0003 210/155
6,588,331 B2 * 7/2003 Thibodeau ..... B30B 9/12 100/110
6,736,054 B2 * 5/2004 Dionne ..... B30B 9/12 100/110

(Continued)

*Primary Examiner* — Sean Michalski
(74) *Attorney, Agent, or Firm* — Alix, Yale & Ristas, LLP

(57) ABSTRACT

The invention relates to a screw press (1) comprising a shaft (4) and a spiral helix (5) provided thereon, wherein the helix (5) goes over in the inlet region (2) of the screw press (1) into a freely projecting helix (8). It is principally characterized in that a tube (9) is provided in the inlet region (2) of the screw press (1). As a result, on the one hand the screen area can be increased greatly in size, on the other hand the co-rotation of the suspension with the shaft can be reduced or avoided.

17 Claims, 3 Drawing Sheets

(56) References Cited

U.S. PATENT DOCUMENTS

| | | | | |
|---|---|---|---|---|
| 7,073,433 | B2 * | 7/2006 | Burke | B30B 9/121 100/110 |
| 7,143,690 | B2 * | 12/2006 | Borjesson | B30B 9/121 100/117 |
| 7,152,522 | B2 * | 12/2006 | Flor | B30B 9/12 100/117 |
| 8,181,570 | B2 * | 5/2012 | Svedberg | B30B 9/122 100/117 |
| 8,191,470 | B2 * | 6/2012 | Magor | B30B 11/246 100/117 |
| 8,403,127 | B2 * | 3/2013 | Tetzlaff | B65G 53/48 198/666 |
| 9,610,747 | B2 * | 4/2017 | Cone | B30B 9/125 |
| 9,737,896 | B2 * | 8/2017 | Sugawara | B04B 1/20 |

* cited by examiner

SCREW PRESS

The invention relates to a screw press with a shaft and helical flight mounted on it, where the flight becomes a freely projecting flight at the inlet area of the screw press.

In general, dewatering screw presses are used to separate liquids from the solids suspended in them. A lot of these thickening and dewatering units are used in the pulp and paper industry in particular because this sector always works with mixtures of water and fibres—in other words suspensions. Dewatering screw presses have proved to be particularly efficient machines for thickening suspensions with a solids content of 3.5% to 4% at the inlet to between 25 and 35% solids content at the outlet. A description of a screw press of this kind can be found, for example, in AT398 090. JP 63154297 A describes a (vertical) filter with a compression screw, where there is no further dewatering in the compression sector. DE 299 01 683 U1 describes a screw press with damming cones and an axially displaceable hollow shaft. In addition, dewatering units are known from U.S. Pat. No. 5,857,405 A and US 2004/0178053 A1, where materials are conveyed into a pipe by means of free flighting and compacted there. In particular, the screening area available is proving to be problematic in state-of-the-art dewatering screw presses. This is the factor that limits dewatering. The larger the screening area is, the greater the dewatering capacity of the press. The screening area is currently defined almost entirely by the diameter and length.

The aim of the invention is thus to increase the screening area within the given length and diameter.

According to the invention, this is achieved by providing a pipe in the inlet area of the screw press over which the freely projecting flight brushes and where preferably a gap is provided between pipe and flight. As a result, the screening area available in the inlet area of the dewatering screw press is enlarged by a factor in the range of 1.5 to 1.8. Here, both the dewatering and the throughput capacity of the screw press are increased.

An advantageous development of the invention is characterised in the pipe have a fixed design and being connected to the frame of the screw press. This ensures that the liquid is carried away properly without creating any difficulties with sealing.

A favourable embodiment of the invention is characterised in the shaft journal of the screw press being surrounded by the freely projecting flight, where the shaft journal is surrounded by the fixed pipe.

A favourable development of the invention is characterised in the fixed pipe being a screen pipe, where the fixed pipe may also have grooves or microscopic/macroscopic surfaces that counteract the co-rotation.

An advantageous embodiment of the invention is characterised in the fixed pipe having at least one filtrate channel, where the filtrate channel can be formed by another pipe between the fixed pipe and the shaft journal.

An advantageous development of the invention is characterised in the filtrate channel being divided into several filtrate channels that are separated from one another by means of web plates.

In the following, the invention is described on the basis of drawings.

Here:

Figure 1:
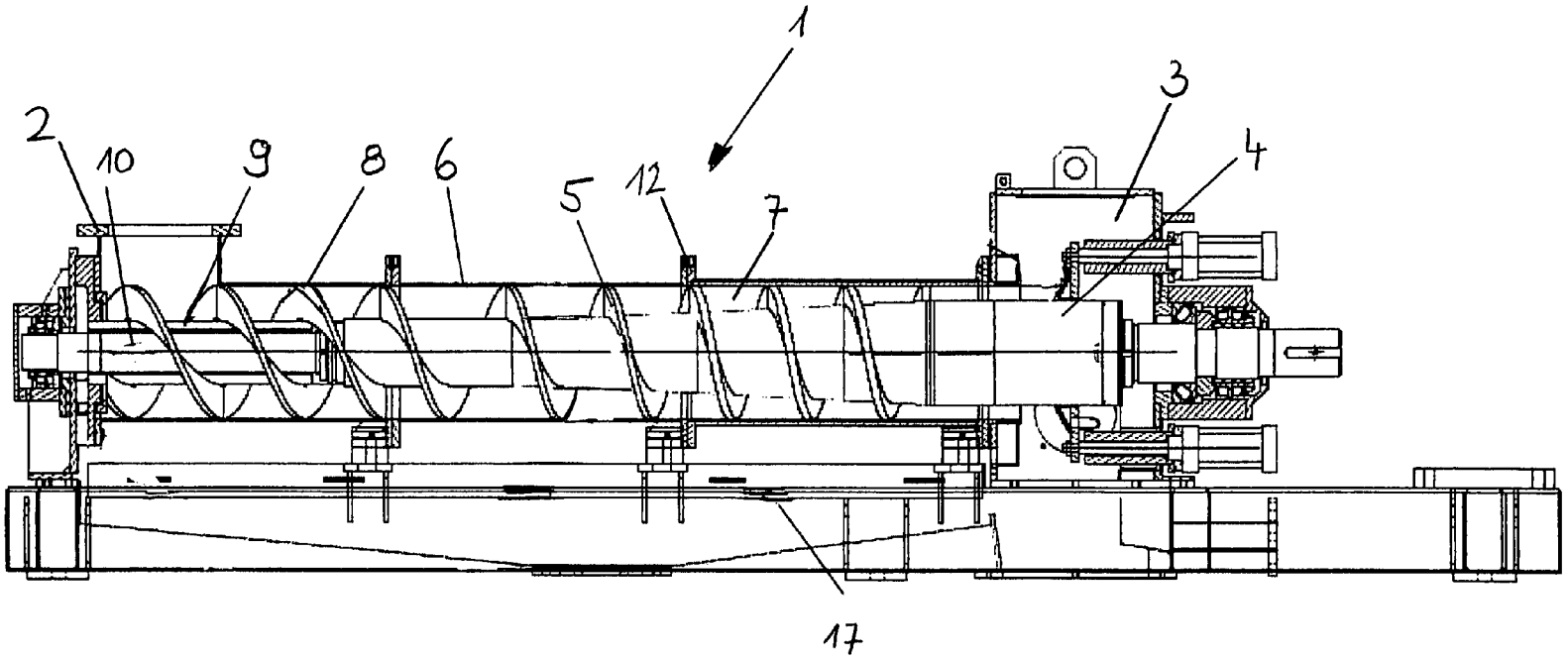
FIG. 1 shows a screw press according to the invention.

A screw press 1 as in FIG. 1 consists of an inlet casing 2, an outlet casing 3, a screw shaft 4 with one or more helical screw flights 5 mounted on the screw shaft, where these screw flights 5 can be continuous or discontinuous, and a casing shell 6 surrounding this screw shaft 4. A conveying gap 7 for the suspension to be dewatered is then formed between the casing shell 6, the screw shaft 4, and the helical screw flight 5. This conveying gap 7 can change its geometry along the axis of the screw shaft 4, however this is not essential.

The principle of the screw press 1 is as follows: The screw shaft 4, which is supported in the casing shell 6 and on bearings, is set in rotating motion by a drive of any kind. A suspension is fed in through the inlet casing 2 connected to the casing shell 6. The rotating shaft 4 moves this suspension through the helical screw flight 5 within the conveying gap 7 in the direction of the outlet casing 3 connected to the casing shell 6. The casing shell 6 of a dewatering screw press 1 is usually designed as a screen. The conveying gap 7 formed by the shaft 4, the screw flight 5 and the casing shell 6 changes its geometry along the shaft axis in the direction of the outlet casing 3 in a way that is beneficial to dewatering. In most cases, the volume available is reduced along the length of the shaft axis in order to force dewatering of the suspension. The liquid released in this process is drained off through the casing shell, which is designed as a screen. In the area of the inlet casing 2, the screw flight 5 becomes a freely projecting helical flight 8. The flighting need not necessarily have two flights (as shown). In order to increase the stability of the flight, it could also be reinforced with a U-profile. A gap is provided between the fixed pipe 9 and freely projecting flight 8 in the inlet area of the screw press 1, along which the flight 8 can brush against fibres that have accumulated on the fixed pipe 9. This pipe 9 is connected securely to the frame of the screw press 1 and does not make any rotating movement. The pipe 9 secured to the press frame is preferably designed as a screen, which enlarges the screening area enormously in the inlet area of the press 1. The pipe 9 need not be designed as a screen pipe, but can also have any kind of groove or a macroscopically or microscopically rough surface. The co-rotation is counteracted by this surface as well as by the grooves or a screen. In addition to better dewatering, this has the effect of stopping the solids suspension (fibrous suspension) from adhering to the metallic surface, thus also guaranteeing solids transport in axial direction.

The shaft journal 10 of the conventional screw shaft 4 runs through the pipe 9 secured to the frame of the press 1 and is then supported in conventional bearings after passing through the casing.

Figure 2:
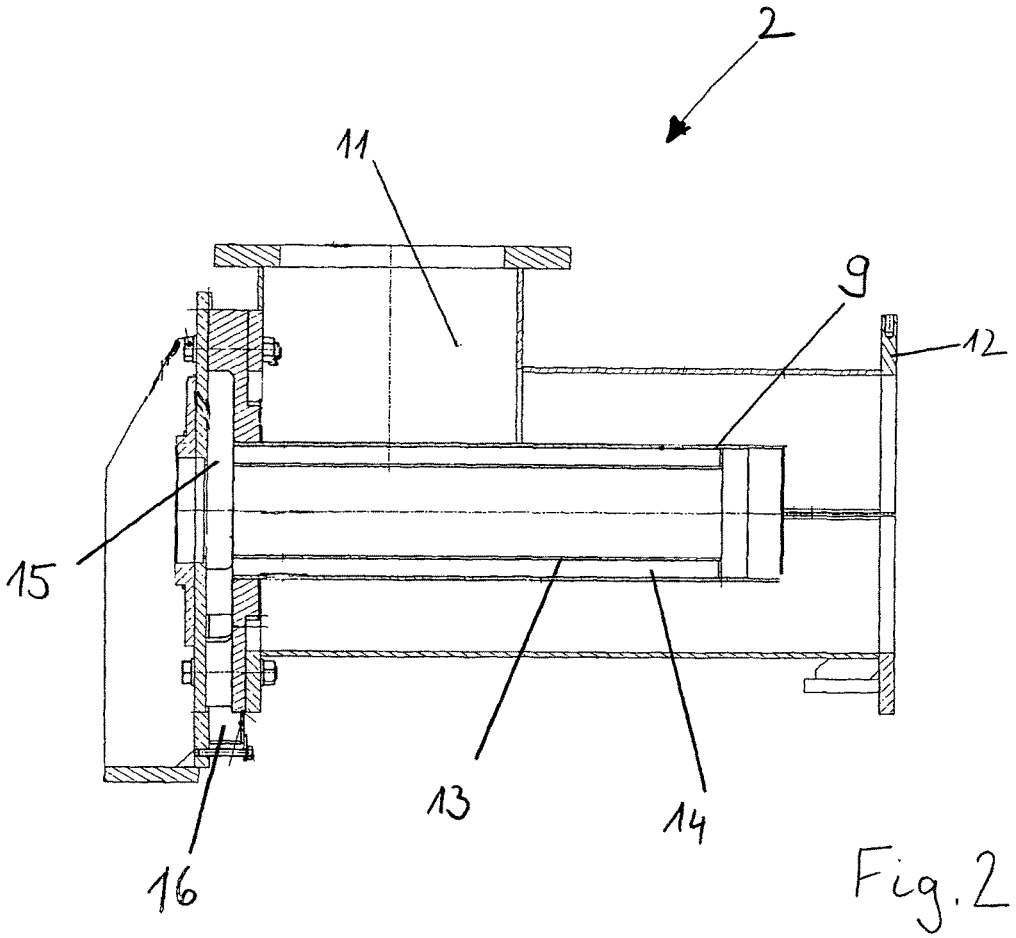
FIG. 2 shows the inlet area of a screw press according to the invention.

FIG. 2 shows the inlet part 2 of a screw press 1 according to the invention. The suspension enters the inlet branch 11. The entire inlet part is connected to the casing shell 6 by a flange 12 in the embodiment shown. Of course, the inlet part can also have a different design. The inlet part 2 has a pipe 9 firmly secured to it, for example as shown here by means of screws. This figure also shows that a concentric pipe 13 with a larger diameter than the shaft journal 10 (not shown) is provided. Pipes 9 and 13 thus form a filtrate channel 14. This filtrate channel 14 can also be divided into several filtrate channels separated from one another by web plates. The filtrate collected in the pipe 9 is then carried through the filtrate channel 14 to the filtrate collecting flange 15 and guided through a filtrate collecting pan 16 into the filtrate tray 17 (FIG. 1) of the screw press, for example, in this embodiment.

Figure 3:
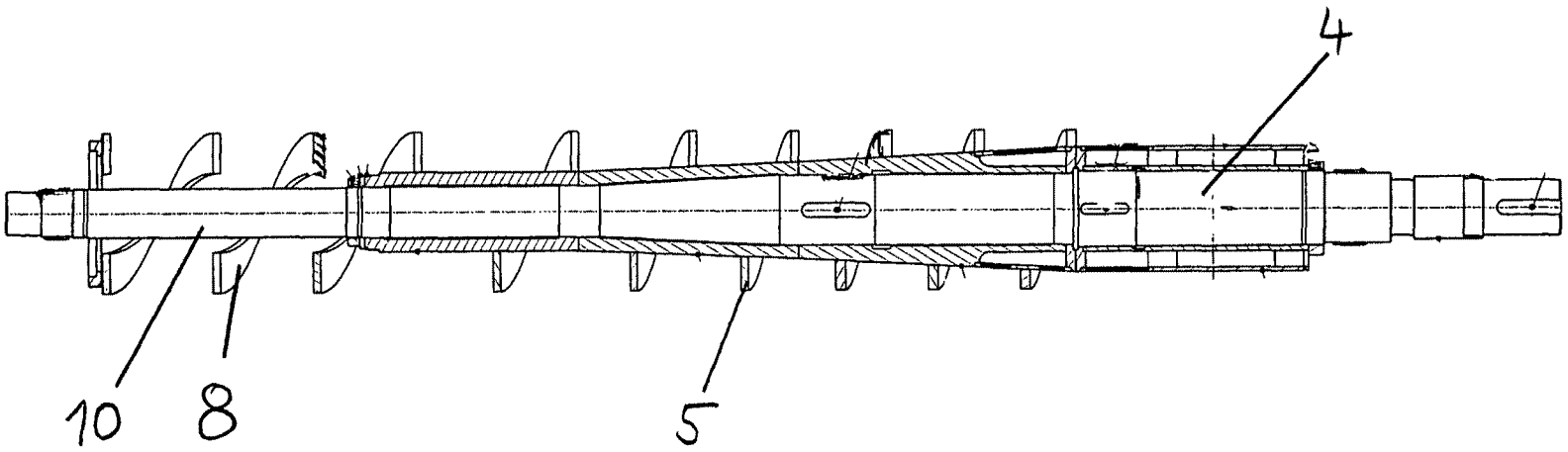
FIG. 3 shows a screw shaft according to the invention.

FIG. 3 now shows a section through a screw shaft 4. The (conventional) screw flight 5 is visible here, as well as the projecting flight 8 and the shaft stub 10.

The present invention offers two advantages over conventional screw presses:

The screening surface in the inlet area 2 of the screw press 1 is enlarged by a factor of 1.5 to 1.8. This results in a significant increase in the dewatering capacity of the press 1.

In addition, co-rotation of the fibre pulp is reduced. Fibre pulps tend to adhere to the rotating shaft. If the fibre pulp adheres to the screw shaft 4, transport in axial direction is reduced or even comes to a halt. The determining factor in this co-rotation is largely the friction conditions prevailing inside the press. In conventional presses and also in the conventional part 4, 5 of the screw press 1, the pulp is prevented from co-rotating by the casing shell 6 of the press 1 designed as a screen. However, the screw shaft 4 tries to set the pulp in a rotating movement. In addition, the pulp adheres to the surface of the screw shaft 4 and then co-rotates at the shaft speed without experiencing any major forward movement in axial direction as it does so. In the present invention, the pulp is prevented from adhering to the rotating screw shaft 4 in the inlet area because only a stationary pipe 9 is installed in the inlet area 2. The pipe 9 is preferably designed as a screen, but may also have any kind of grooves or a macroscopically or microscopically rough surface. These grooves or macroscopically or microscopically rough surface can also be applied to a pipe 9 designed as a screen. The screw shaft 4 or rather the journal 10 rotates inside this pipe 9. Both the screen-type casing shell 6 and the screen pipe 9 used in the inlet area 2 prevent the pulp from rotating. The projecting flight 8 brushes over the screen pipe 9 and transports the pulp forwards in axial direction only. This leads to a considerable increase in transport efficiency and thus to increased removal of material from the inlet area 2 of the press 1, which causes a rise in the inlet mass flow.

The invention claimed is:

1. A screw press comprising:

a screw including a shaft with helical flight rotatable about an axis;

a casing shell surrounding the screw between an inlet end of the screw and an outlet end of the screw;

an inlet casing connected to the casing shell for delivering a suspension to the inlet end of the screw;

an outlet casing connected to the casing shell for discharging a pressed suspension from the outlet end of the screw;

wherein the inlet end of the screw includes a flight in the inlet casing;

the flight at the inlet end of the screw freely projects from the screw shaft; and a screen pipe extends coaxially within the freely projecting flight;

whereby the freely projecting flight rotates closely around the screen pipe as the screw rotates within the casing shell.

2. The screw press of claim 1, wherein the screw press includes a frame and the screen pipe is connected to the frame in a rotationally fixed position within the freely projecting flight.

3. The screw press of claim 2, wherein the shaft includes a shaft journal extending axially through the inlet casing and supported in a bearing carried by the frame;

the screen pipe coaxially extends in spaced relation around the shaft journal; and a filtrate channel is defined in the space between the screen pipe and the shaft journal.

4. The screw press of claim 3, wherein the filtrate channel is defined between the screen pipe and another pipe that extends coaxially around the shaft journal.

5. The screw press of claim 3, wherein the screen pipe has a rough surface that counteracts co-rotation of suspension with the freely projecting flight.

6. The screw press of claim 2, wherein the inlet casing is connected to the frame and has a vertically oriented inlet branch;

the screen pipe extends axially through the vertical branch to a rigid connection on the frame;

a filtrate channel extends axially within the screen pipe to the frame; and a filtrate collection volume is provided at the connection of the screen pipe to the frame.

7. The screw press of claim 6, wherein the filtrate channel is divided into a plurality of filtrate channels that are separated from each other by web plates.

8. The screw press of claim 2, wherein the screen pipe coaxially extends in spaced relation around the shaft; and a filtrate channel is defined in the space between the screen pipe and the shaft.

9. The screw press of claim 8, wherein the filtrate channel is defined between the screen pipe and another pipe that extends coaxially around the shaft.

10. The screw press of claim 1, wherein the shaft includes a shaft journal extending axially through the inlet casing, surrounded by the freely projecting flight.

11. The screw press of claim 1, wherein the shaft includes a shaft journal extending axially through the inlet casing, surrounded by the screen pipe.

12. The screw press of claim 1, wherein the screen pipe has a rough surface that counteracts co-rotation of suspension with the freely projecting flight.

13. The screw press of claim 1, wherein the screen pipe includes a filtrate channel.

14. The screw press of claim 13, wherein the filtrate channel is formed between the screen pipe and another coaxial pipe within the screen pipe.

15. The screw press of claim 1, wherein the shaft includes a shaft journal extending axially through the inlet casing;

the screen pipe coaxially extends in spaced relation around the shaft journal; and a filtrate channel is defined in the space between the screen pipe and the shaft journal.

16. The screw press of claim 15, wherein the filtrate channel is defined between the screen pipe and another pipe that extends coaxially around the shaft journal.

17. The screw press of claim 15, wherein the screen pipe has a rough surface that counteracts co-rotation of suspension with the freely projecting flight.

* * * * *